US007866654B2

(12) United States Patent
Ohno

(10) Patent No.: US 7,866,654 B2
(45) Date of Patent: Jan. 11, 2011

(54) SHEET CONVEYING APPARATUS

(75) Inventor: Masahiro Ohno, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/207,400

(22) Filed: Sep. 9, 2008

(65) Prior Publication Data

US 2009/0072467 A1 Mar. 19, 2009

Related U.S. Application Data

(60) Provisional application No. 60/972,236, filed on Sep. 13, 2007.

(51) Int. Cl.
*B65H 3/44* (2006.01)

(52) U.S. Cl. ..... 271/9.08; 271/9.03; 271/9.12; 271/157; 271/162; 271/164; 414/795.8

(58) Field of Classification Search ..... 271/9.03, 271/9.07, 9.08, 9.12, 157–159, 162, 164; 414/790.3, 795.8
See application file for complete search history.

(56) References Cited

U.S. PATENT DOCUMENTS 4,192,496 A * 3/1980 Baselice et al. ..... 271/10.07
4,765,790 A * 8/1988 Besemann ..... 414/790.4
5,096,181 A * 3/1992 Menon et al. ..... 271/157
5,150,893 A * 9/1992 Uno et al. ..... 271/157
5,195,734 A * 3/1993 Tanabe ..... 271/9.03
5,308,053 A * 5/1994 Toki et al. ..... 271/9.08
5,335,903 A * 8/1994 Martin et al. ..... 271/157
5,386,981 A * 2/1995 Sugimoto et al. ..... 271/3.03
5,404,817 A * 4/1995 Cuff ..... 101/232
5,971,387 A * 10/1999 Kita ..... 271/9.03
6,547,234 B1 * 4/2003 Quesnel ..... 271/9.08
6,685,181 B2 * 2/2004 Bakodledis ..... 271/9.03
2004/0070134 A1 * 4/2004 Eskey ..... 271/9.07

FOREIGN PATENT DOCUMENTS

JP 2557116 9/1996
JP 2625024 4/1997
JP 2625057 4/1997

* cited by examiner

*Primary Examiner*—Stefanos Karmis
*Assistant Examiner*—Jeremy Severson
(74) *Attorney, Agent, or Firm*—Patterson & Sheridan, LLP

(57) ABSTRACT

A sheet conveying apparatus includes a first storing unit in which a sheet bundle is stacked, a second storing unit that is provided near the first storing unit and in which the sheet bundle is stacked, a transfer tray that is provided in the second storing unit and transfers the sheet bundle from the second storing unit to the first storing unit, and a stopper that regulates, when the transfer tray transfers the stacked sheet bundle from the second storing unit to the first storing unit and moves from the first storing unit to the second storing unit, movement of the sheet bundle on the transfer tray.

15 Claims, 15 Drawing Sheets

SHEET CONVEYING APPARATUS

CROSS-REFERENCE TO RELATED APPLICATION

This application is based upon and claims the benefit of priority from prior Applications No. 60/972,236, filed Sep. 13, 2007, the entire contents of which are incorporated herein by reference.

TECHNICAL FIELD

The present invention relates to a sheet conveying apparatus that has a sheet cassette in which sheet bundles to be fed can be horizontally stacked side by side.

BACKGROUND

Conventionally, there is a tandem large capacity feeder (hereinafter referred to as tandem LCF) as one of large capacity paper feeding apparatuses in which sheet bundles to be fed can be horizontally stacked side by side. The tandem LCF has the structure including, in the inside of one paper feeding apparatus, two trays that store two sheet bundles.

In the tandem LCF, paper feeding mechanisms that respectively discharge sheets to trays on which sheet bundles are stacked in the inside of a paper feeding apparatus are provided. In the tandem LCF having such plural paper feeding mechanisms, there are problems of an increase in size of the paper feeding apparatus, a decrease in a stacking amount of sheet bundles stored in the paper feeding apparatus, and manufacturing cost.

Another tandem LCF in the past has the structure in which a paper feeding mechanism is provided for only one of trays on which a sheet bundle is stacked. As shown in FIGS. 27 to 30, in such a tandem LCF, when a sheet bundle stacked on a first tray 901 for which the paper feeding mechanism is exhausted, a sheet bundle P stacked on a second tray 902 is transferred to the first tray 901.

However, when the sheet bundle P stacked on the second tray 902 is transferred to the first tray 901 provided in the paper feeding mechanism, as shown in FIG. 28, the second tray 902 is moved to a position above the first tray 901. The second tray 902 on which the sheet bundle P is stacked is once lowered after the second tray 902 reaches the first tray 901 as shown in FIG. 29. As shown in FIG. 30, the second tray 902 returns to an original predetermined position after the sheet bundle P is transferred to the first tray 901.

Therefore, a configuration of the tandem LCF is complicated. In order to realize such a configuration, the tandem LCF requires spaces in both a height direction and a horizontal direction. Since a large number of sheets are stacked on the second tray 902, the second tray is required not to hang down because of the weight of the sheet bundle P. Therefore, rollers are arranged on a lower surface of the second tray 902. The second tray 902 moves to the first tray 901 side along a rail. The second tray 902 lowers the sheet bundle P in order to transfer the sheet bundle P to the first tray 901. In lowering the sheet bundle P, since the rollers are obstacles, it is necessary to permit the rollers to escape. Therefore, such a tandem LCF has problems in terms of cost and spaces.

In order to prevent the second tray 902 to hang down, even when the second tray 902 and a holding section are firmly fixed, the problems in cost and spaces are inevitable.

Therefore, the present invention provides a sheet conveying apparatus that can smoothly transfer a sheet bundle in the tandem LCF.

SUMMARY

According to one aspect of the present invention, there is provided a sheet conveying apparatus including a first storing unit in which a sheet bundle is stacked, a second storing unit that is provided near the first storing unit and in which the sheet bundle is stacked, a transfer tray that is provided in the second storing unit and transfers the sheet bundle from the second storing unit to the first storing unit, and a stopper that regulates, when the transfer tray transfers the stacked sheet bundle from the second storing unit to the first storing unit and moves from the first storing unit to the second storing unit, movement of the sheet bundle on the transfer tray.

DETAILED DESCRIPTION

An embodiment is explained below.

Figure 1:
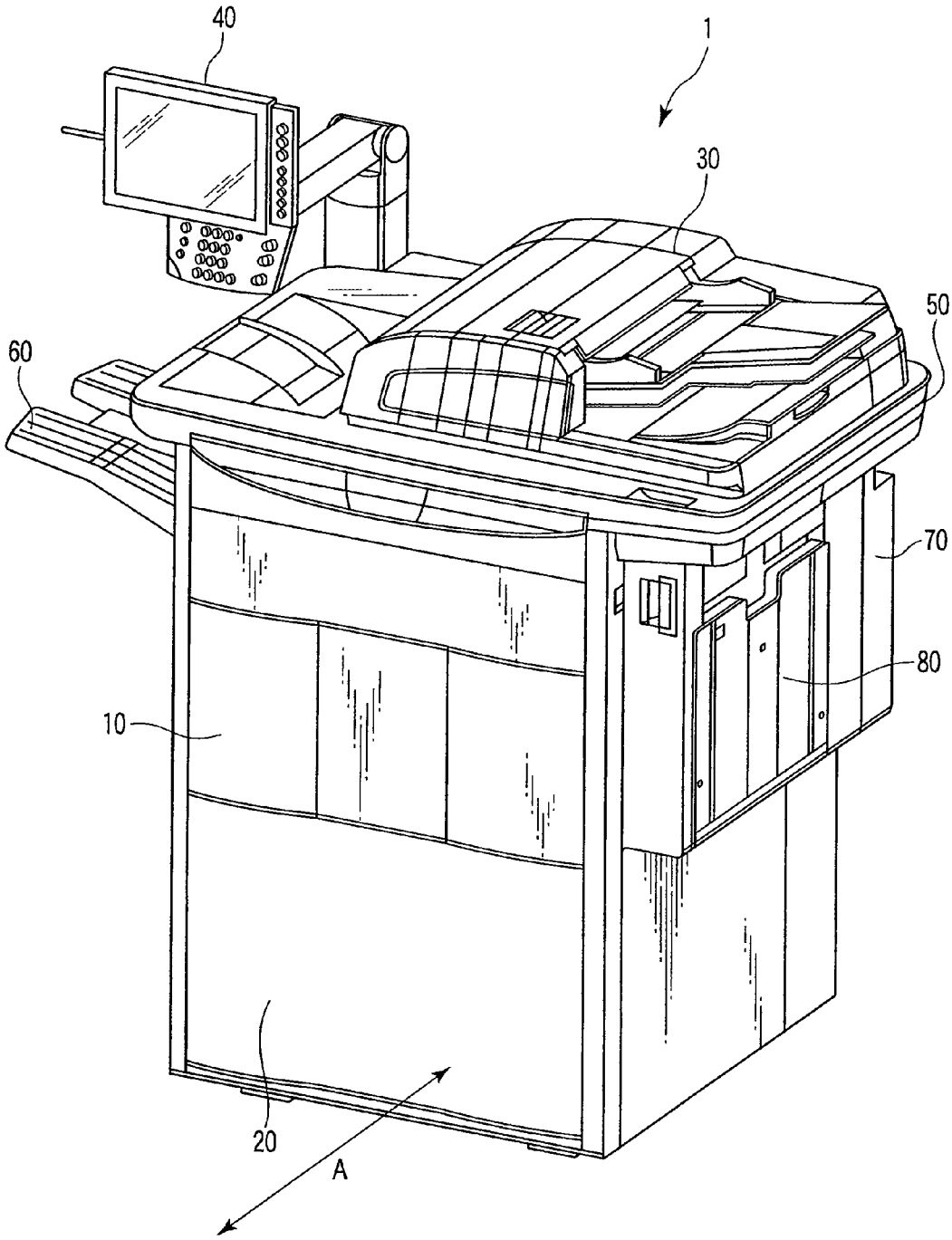
FIG. 1 is a schematic diagram showing an external appearance of an image forming apparatus according to an embodiment.

FIG. 1 is a perspective view showing an external appearance of an image forming apparatus 1 according to an embodiment. The image forming apparatus 1 includes an image forming unit 10 for outputting image information as an output image called, for example, a hard copy or a printout, a sheet feeding unit 20 that can feed a sheet (an output medium) of an arbitrary size used for image output to the image forming unit 10, and a scanner that captures, as image data, image information, which is an object of image formation, from an object that keeps the image information (hereinafter referred to as original). An automatic document feeder 30 that discharges, when the original is sheet-like, after scanning of the image information in the scanner is finished, the original for which the scanning is finished from a scanning position to a discharge position and guides the next original to the scanning position is provided above the image forming unit 10. An instruction input unit for instructing the start of image formation in the image forming unit 10 and the start for scanning of image information of an original by the scanner 50, i.e., a control panel 40, is provided in the image forming apparatus 1.

A paper discharge tray 60 that discharges a sheet on which an image is printed by the image forming unit 10 is provided on a side of the image forming apparatus 1. A first opening and closing member 70 and a second opening and closing member 80 are provided on a side on the opposite side of the side on which the paper discharge tray 60 is provided.

Figure 26:
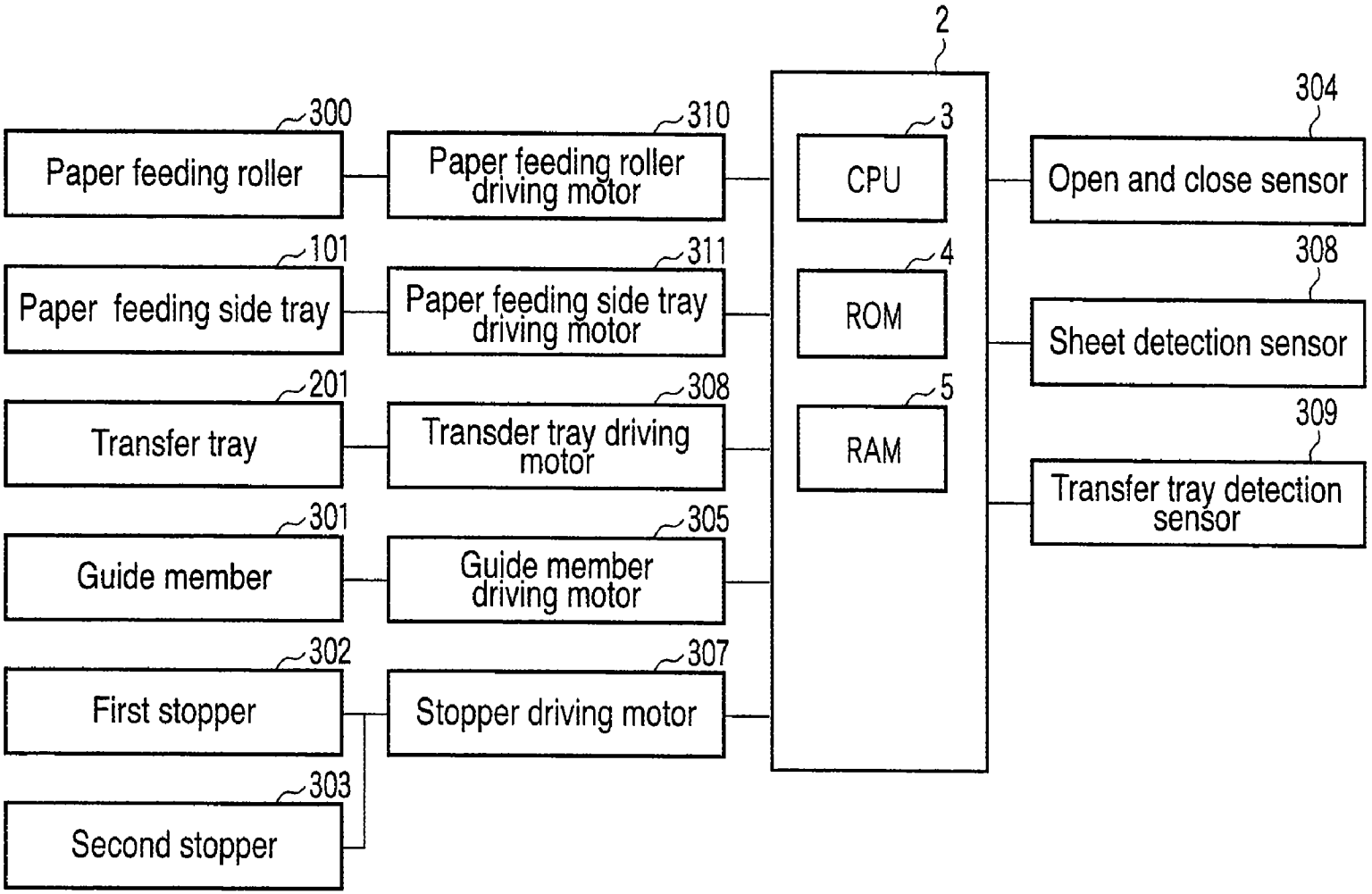
FIG. 26 is a block diagram showing a control system of the image forming apparatus according to the embodiment.
Figure 27:
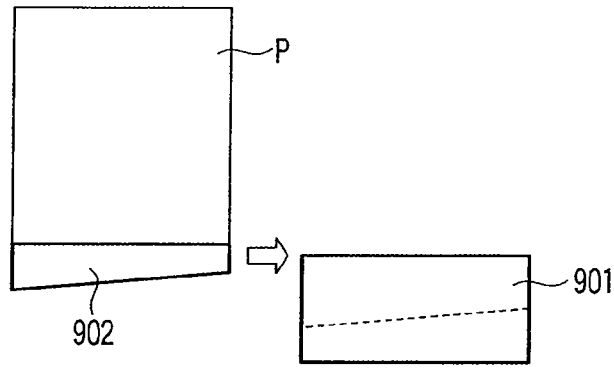
FIG. 27 is a diagram showing the structure of a tandem LCF in the past.
Figure 28:
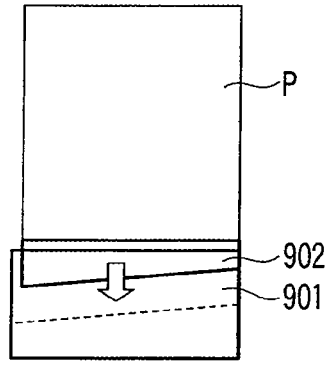
FIG. 28 is a diagram showing the structure of the tandem LCF in the past.
Figure 29:
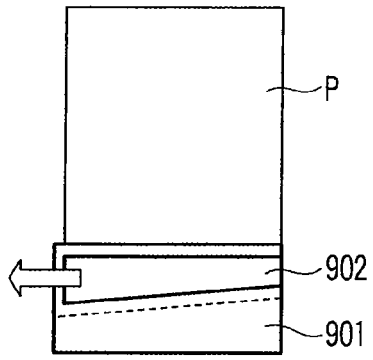
FIG. 29 is a diagram showing the structure of the tandem LCF in the past.
Figure 30:
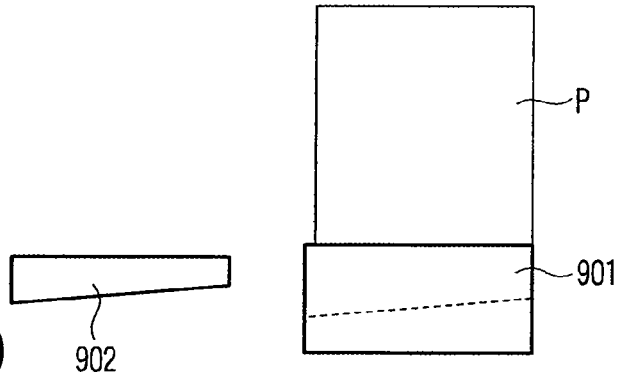
FIG. 30 is a diagram showing the structure of the tandem LCF in the past.

The first opening and closing member 70 is a sheet conveying unit provided to be connected to the image forming unit 10. The second opening and closing member 80 is a sheet manual feed unit provided to come into contact with the first opening and closing member 70. A block diagram showing a control system of the image forming apparatus 1 according to this embodiment is shown in FIG. 26. A control device 2 includes a CPU 3, a ROM 4, and a RAM 5. The CPU 3 controls respective sensors and respective motors on the basis of control information recorded in the ROM 4 in advance. The RAM 5 temporarily records necessary information.

Figure 2:
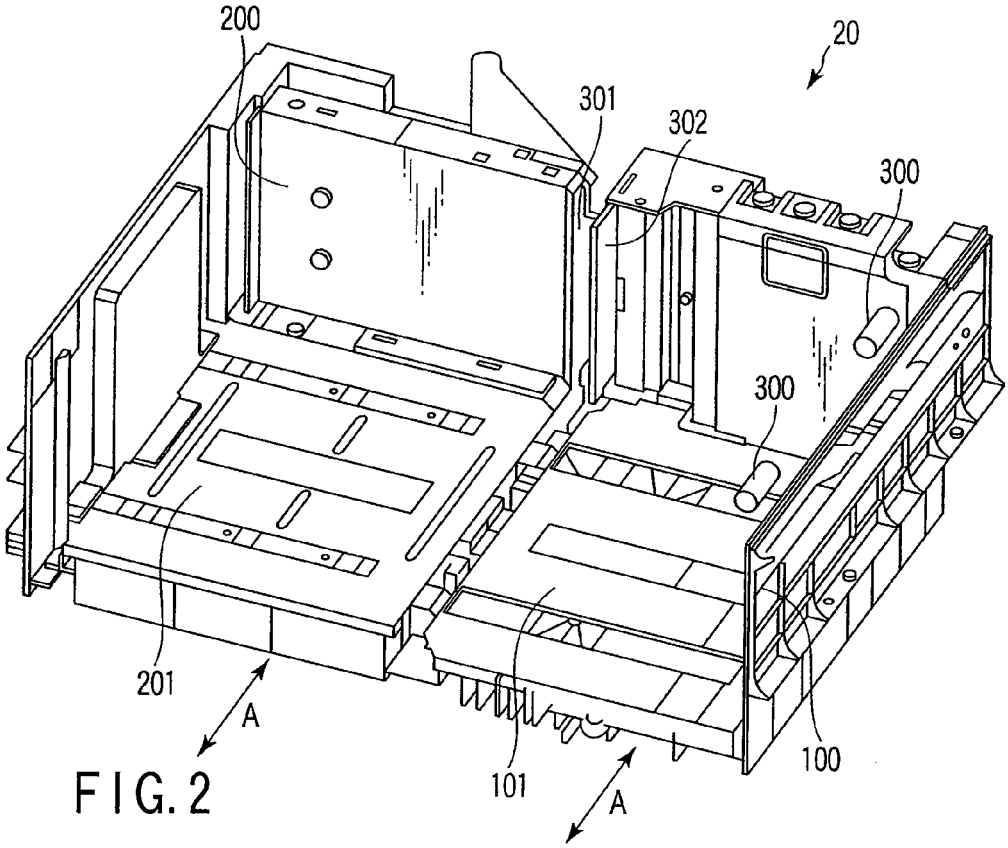
FIG. 2 is a perspective view showing the structure of a tandem LCF according to the embodiment.
Figure 3:
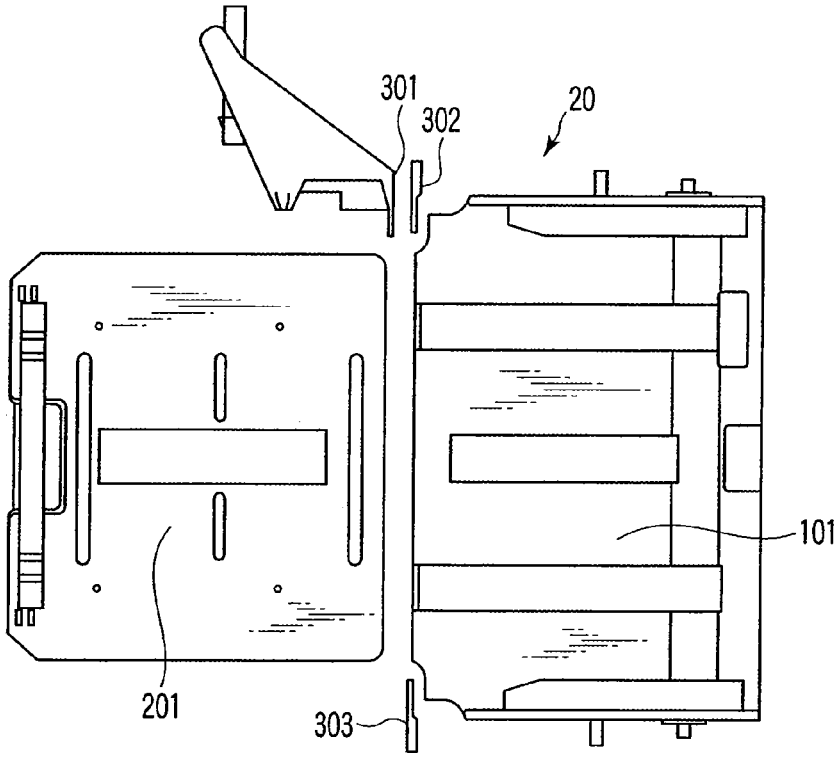
FIG. 3 is a top view showing the structure of the tandem LCF according to the embodiment.

FIG. 2 is a perspective view showing the structure of a tandem LCF 20 applied as the sheet feeding unit 20 shown in FIG. 1 according to this embodiment. An arrow A indicates a direction in which the tandem LCF 20 is inserted in and drawn out from the image forming apparatus 1. FIG. 3 is a top view showing the structure of the tandem LCF 20. FIGS. 2 and 3 show a state in which the tandem LCF 20 in which the sheet bundle P is not stacked is drawn out from the image forming apparatus 1.

The tandem LCF 20 includes a first storing unit 100 and a second storing unit 200 provided near the first storing unit 100 as one body. The sheet bundle P fed to the image forming unit 10 is stacked in the first storing unit 100. The first storing unit 100 is a paper feeding side in which a paper feeding roller 300 is provided as a paper feeding member that feeds sheets one by one from the top of the sheet bundle P. The CPU 3 drives, on the basis of an input for print processing by a user, the paper feeding roller 300 using a paper feeding roller driving motor 310 and feeds paper to the image forming unit 10. The first storing unit 100 includes a paper feeding side tray 101. The CPU 3 drives a paper feeding side tray driving motor 311 according to a decrease in the number of sheets P stacked on the paper feeding side tray 101 and moves the paper feeding side tray 101 upward to a position in contact with the paper feeding roller 300 in order to press the sheet bundle P against the paper feeding roller 300.

The sheet bundle P transferred to the first storing unit 100 when all the sheets of the sheet bundle P stacked in the first storing unit 100 are fed by the paper feeding roller 300 are stacked in the second storing unit 200. The second storing unit 200 is a waiting side including a transfer tray 201 that transfers the sheet bundle P to the first storing unit 100 when all the sheets of the sheet bundle P stacked in the first storing unit 100 are fed by the paper feeding roller 300. The user can draw out the first storing unit 100 and the second storing unit 200 from the image forming apparatus 1 independently from each other and supply the sheet bundle P therein.

In the tandem LCF 20, a guide member 301 is provided on a side between the first storing unit 100 and the second storing unit 200, i.e., between the paper feeding side and the waiting side. The guide member 301 is a member for correctly setting the sheet bundle P in the second storing unit 200 using a first stopper 302 and a second stopper 303.

Further, in the tandem LCF 20, the first stopper 302 and the second stopper 303 are provided on the side between the first storing unit 100 and the second storing unit 200, i.e., between the paper feeding side and the waiting side. The first stopper 302 and the second stopper 303 play a role for correctly setting the sheet bundle P in the first storing unit 100. The user can correctly set the sheet bundle P in predetermined positions of the first storing unit 100 and the second storing unit 200.

The first stopper 302 and the second stopper 303 move from two places opposed to each other to the center in a direction orthogonal to a transfer direction of the sheet bundle P to divide the first storing unit 100 and the second storing unit 200. After the transfer tray 201 transfers the sheet bundle P to the paper feeding side tray 101, the first stopper 302 and the second stopper 303 regulate movement of the sheet bundle P not to return to the second storing unit 200 in a state in which the sheet bundle P is stacked on the transfer tray 201.

Figure 4:
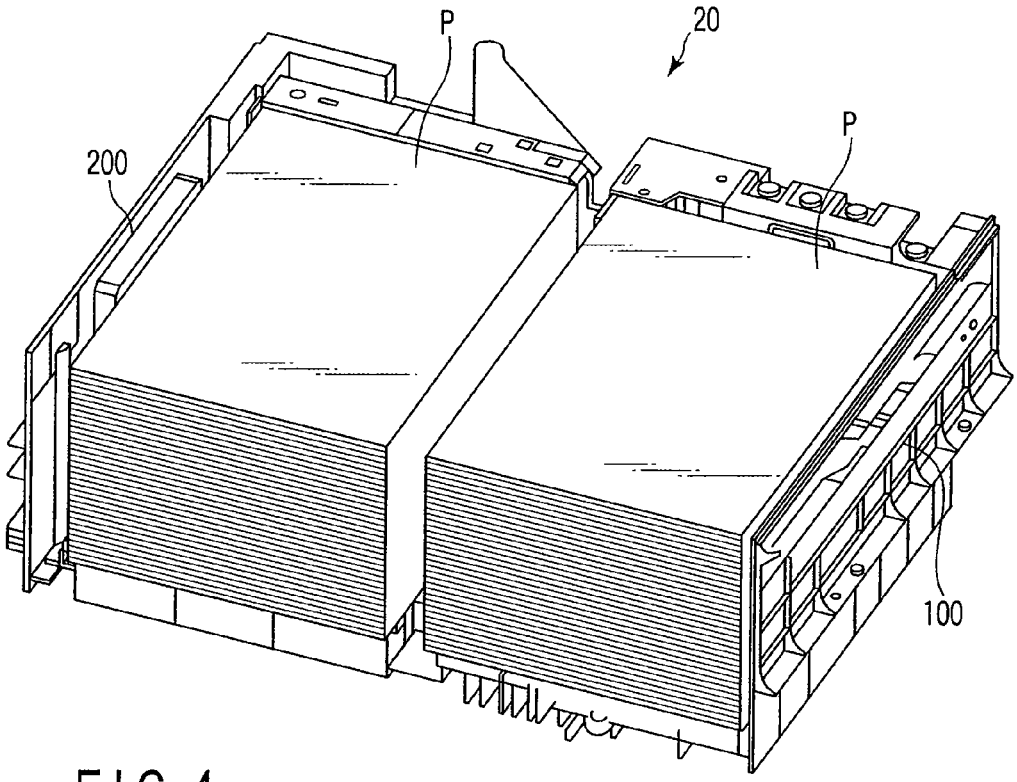
FIG. 4 is a perspective view showing the structure of the tandem LCF according to the embodiment.
Figure 5:
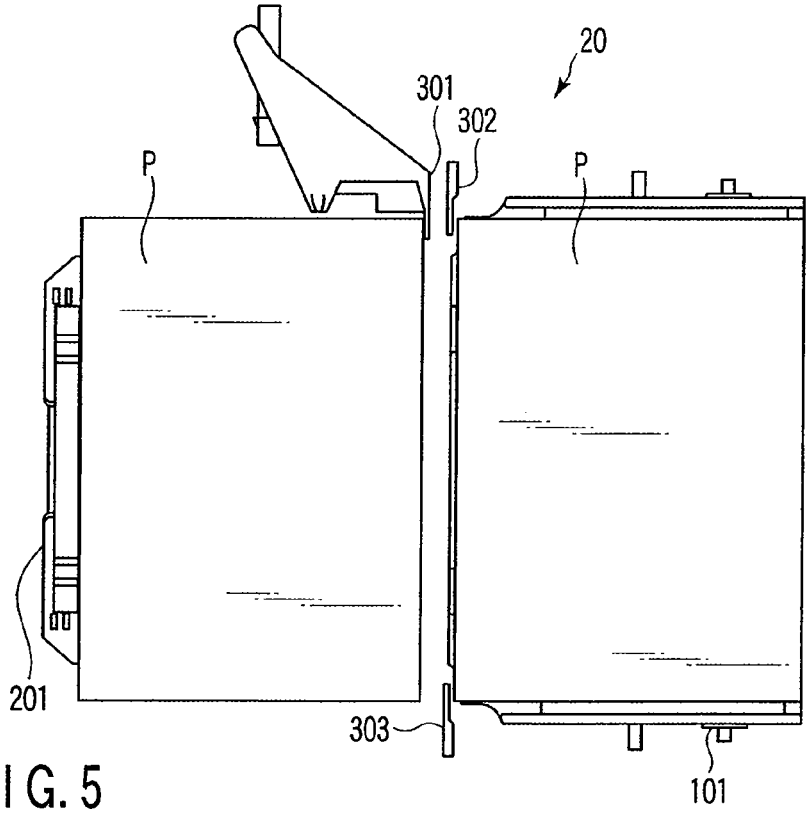
FIG. 5 is a top view showing the structure of the tandem LCF according to the embodiment.

FIG. 4 is a perspective view showing the structure of the tandem LCF 20 in which the sheet bundles P are stacked in the first storing unit 100 and the second storing unit 200, respectively. FIG. 5 is a top view showing the structure of the tandem LCF 20 shown in FIG. 4. The tandem LCF 20 is drawn out from the image forming apparatus 1. The user can stack the sheet bundles P on the first storing unit 100 and the second storing unit 200, respectively. The sheet bundle P is stacked on the paper feeding tray 101 in the first storing unit 100. The sheet bundle P is stacked on the paper feeding tray 201 in the second storing unit 200.

Figure 6:
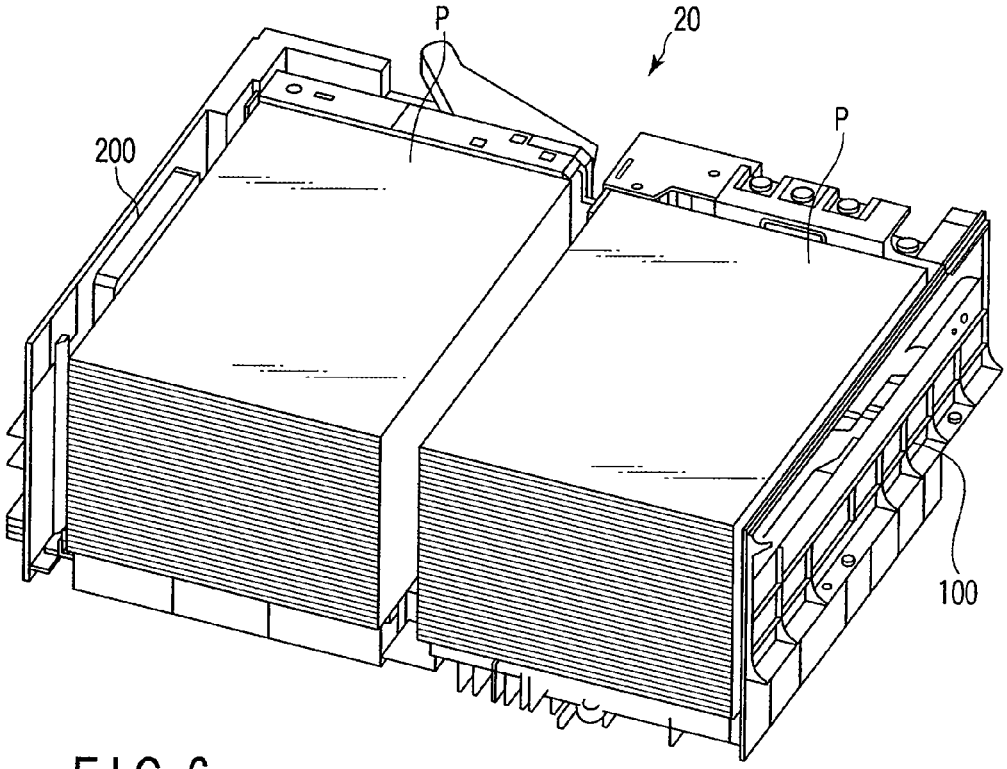
FIG. 6 is a perspective view showing the structure of the tandem LCF according to the embodiment.
Figure 7:
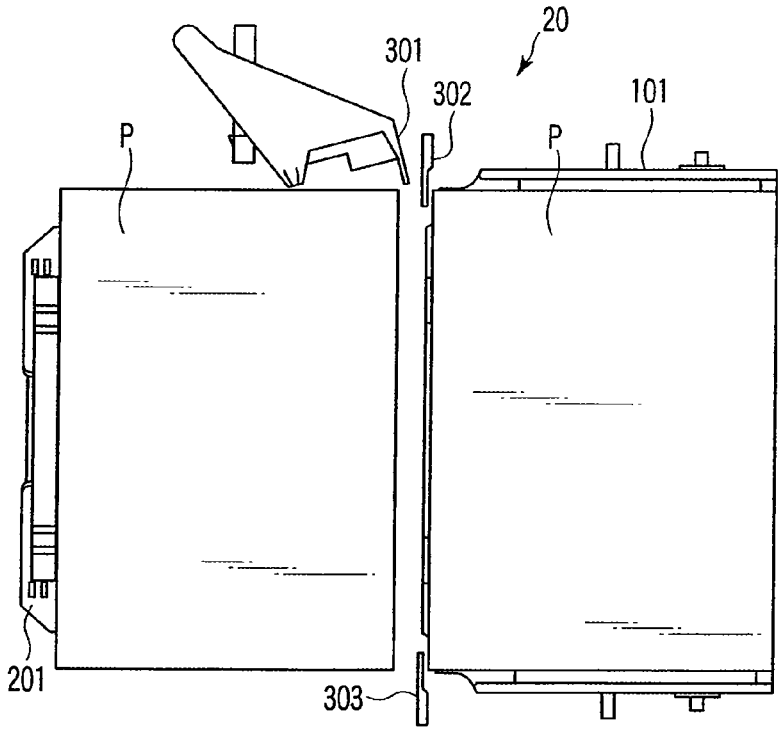
FIG. 7 is a top view showing the structure of the tandem LCF according to the embodiment.

FIG. 6 is a perspective view showing the structure of the tandem LCF 20 inserted in the image forming apparatus 1 from the state shown in FIGS. 4 and 5 in which the sheet bundles P are stacked in the first storing unit 100 and the second storing unit 200. FIG. 7 is a top view showing the structure of the tandem LCF 20 shown in FIG. 6.

When the tandem LCF 20 is inserted into the image forming unit 1, the CPU 3 detects the insertion of the tandem LCF 20 into the image forming apparatus 1 using an open and close sensor 304 provided in a predetermined position of the image forming apparatus 1. The CPU 3 drives a guide member driving motor 305 to move, to prevent the guide member 301 from impeding the transfer of the sheet bundle P, the guide member 301 to a position where the guide member 301 is opposed to no portion of the sheet bundle P in a direction from the first storing unit 100 to the second storing unit 200.

Figure 8:
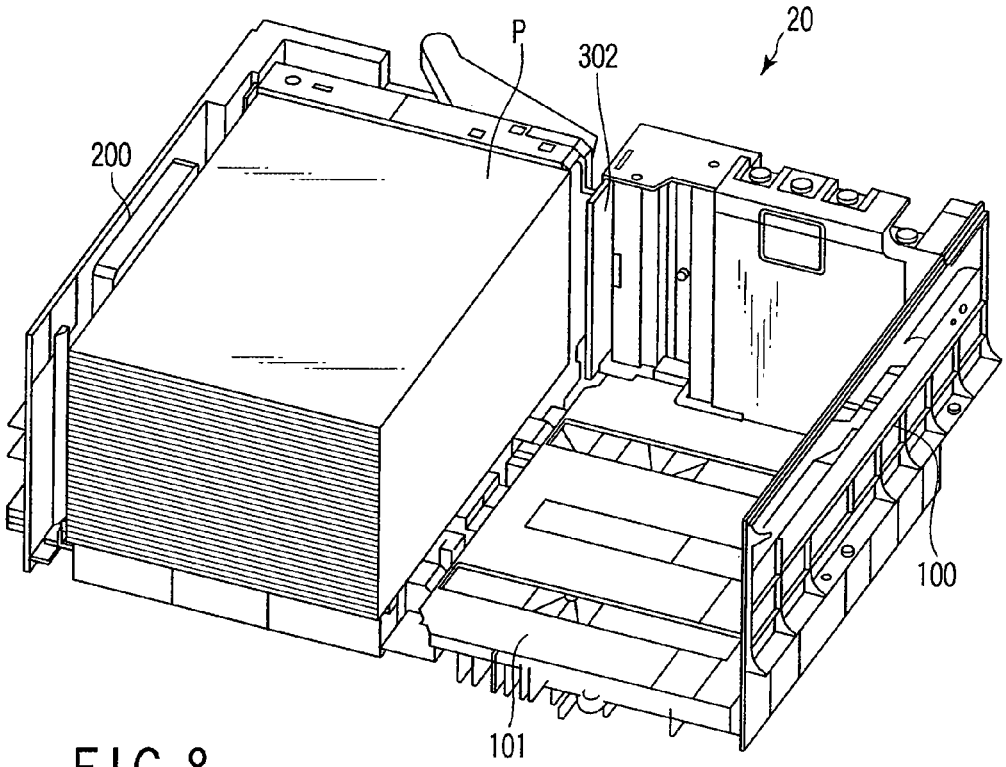
FIG. 8 is a perspective view showing the structure of the tandem LCF according to the embodiment.
Figure 9:
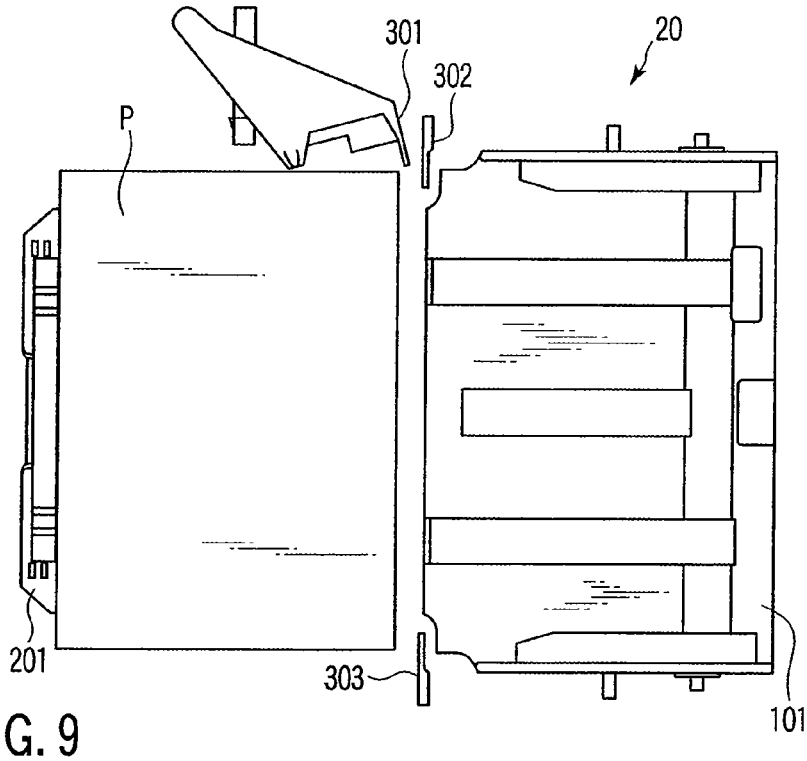
FIG. 9 is a top view showing the structure of the tandem LCF according to the embodiment.

FIG. 8 is a perspective view showing the structure of the tandem LCF 20 in a state in which all the sheets of the sheet bundle P stacked in the first storing unit 100 are fed by the paper feeding roller 300 from the state shown in FIGS. 6 and 7 and the sheet bundle P is stacked only in the second storing unit 200. FIG. 9 is a top view showing the structure of the tandem LCF 20 in the state shown in FIG. 8.

Figure 10:
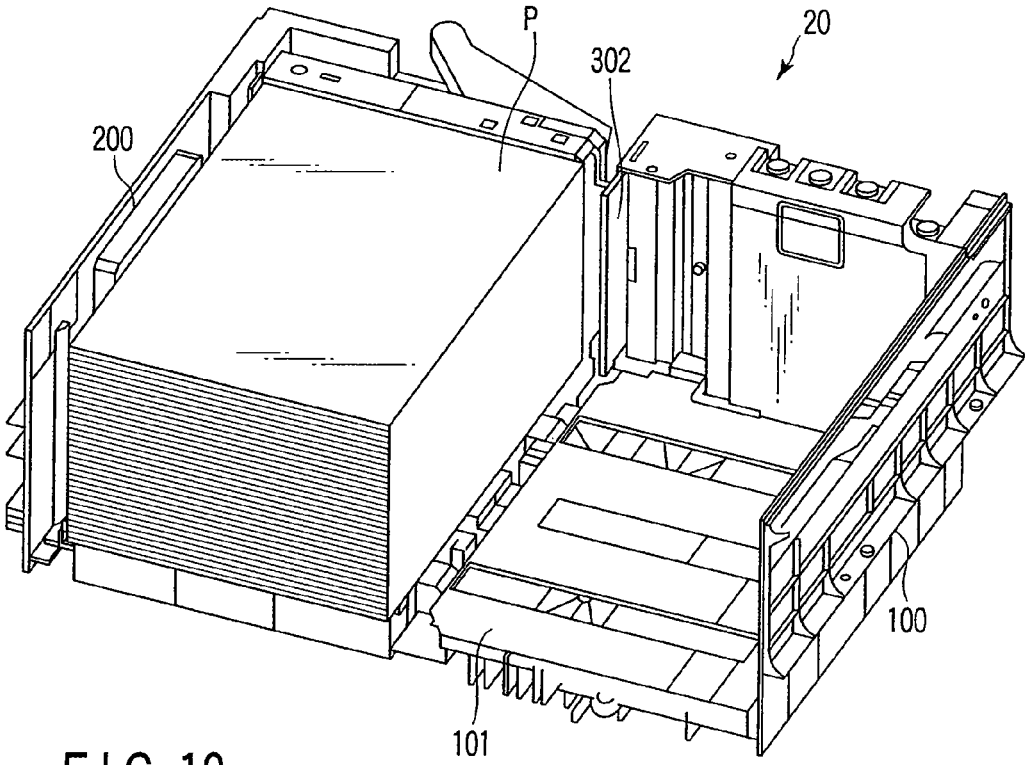
FIG. 10 is a perspective view showing the structure of the tandem LCF according to the embodiment.
Figure 11:
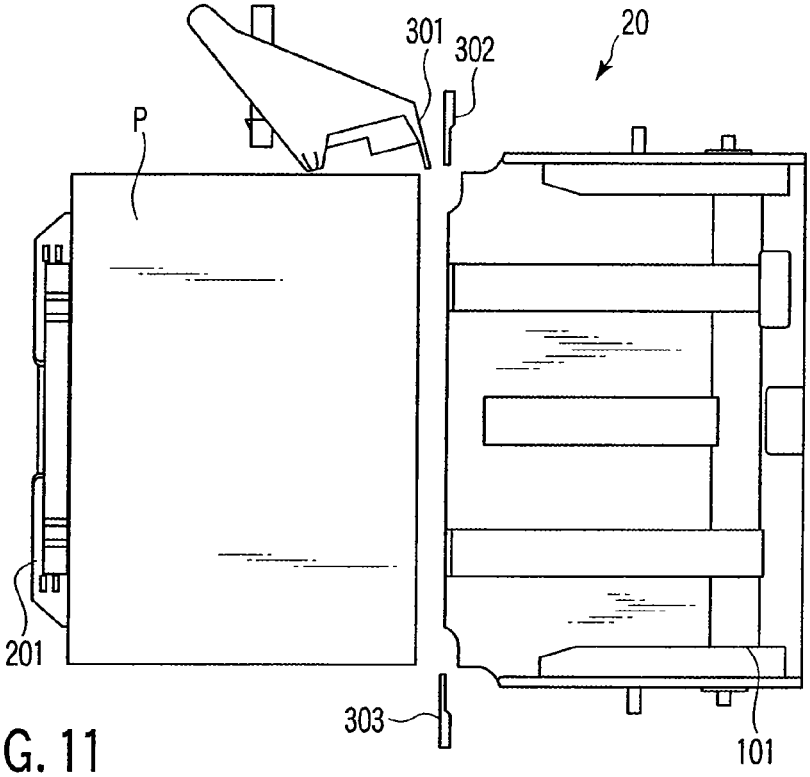
FIG. 11 is a top view showing the structure of the tandem LCF according to the embodiment.

FIG. 10 is a perspective view showing the structure of the tandem LCF 20 in a state in which the first stopper 302 and the second stopper 303 move in the state shown in FIGS. 8 and 9. FIG. 11 is a top view showing the structure of the tandem LCF 20 shown in FIG. 10.

When it is determined by a sheet detection sensor 306, which is arranged in a predetermined position of the first storing unit 100, that all the sheets P stacked in the first storing unit 100 are fed, the CPU 3 drives a stopper driving motor 307 to move the first stopper 302 and the second stopper 303 to a position where the first stopper 302 and the second stopper 303 are opposed to no portion of the sheet bundle P.

Figure 12:
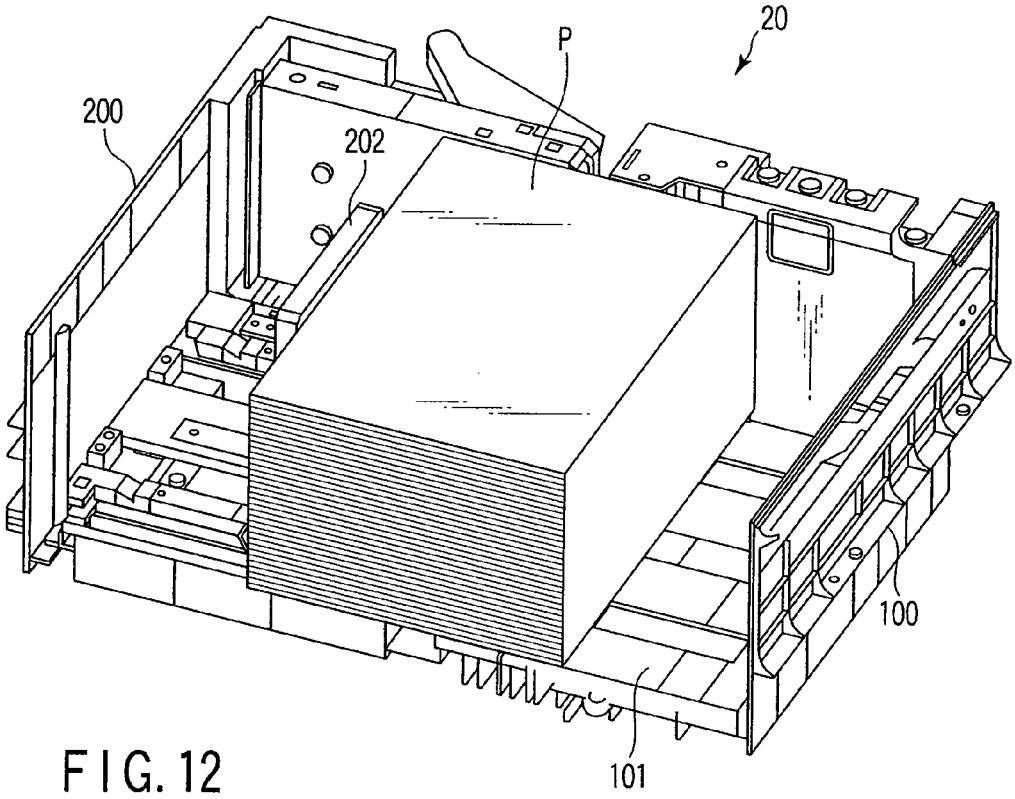
FIG. 12 is a perspective view showing the structure of the tandem LCF according to the embodiment.
Figure 13:
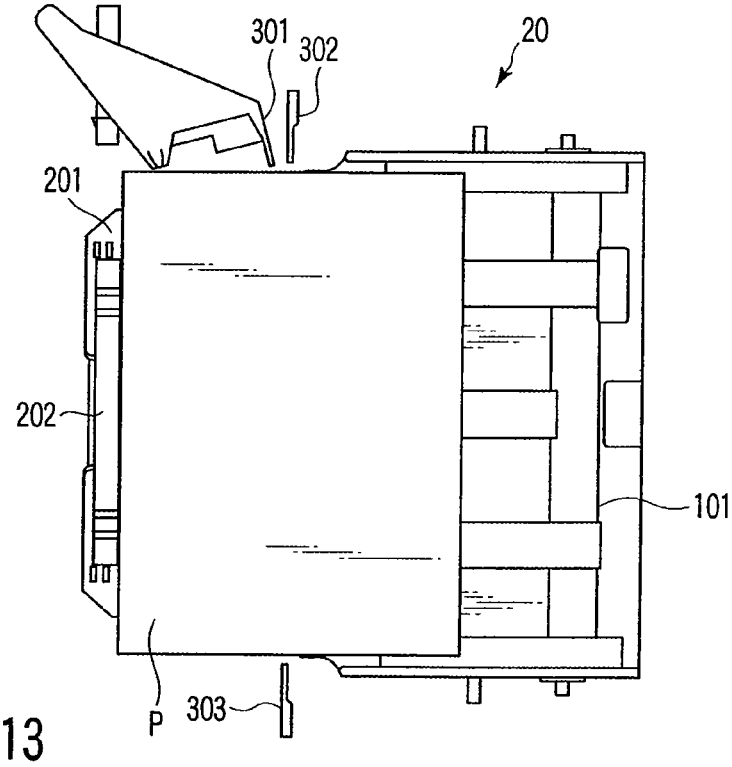
FIG. 13 is a top view showing the structure of the tandem LCF according to the embodiment.

FIG. 12 is a perspective view showing the structure of the tandem LCF 20 in a state in which the transfer tray 201 starts to transfer the sheet bundle P stacked in the second storing unit 200 to the first storing unit 100 from the state shown in FIGS. 10 and 11. FIG. 13 is a top view showing the structure of the tandem LCF 20 shown in FIG. 12.

When it is determined that the movement of the first stopper 302 and the second stopper 303 is completed, the CPU 3 drives a transfer tray driving motor 308 to start transfer of the sheet bundle P by the transfer tray 201.

The transfer tray 201 includes a trailing end guide member 202 in a direction from the second storing unit 200 to the first storing unit 100. The trailing end guide member 202 comes into contact with a side of a trailing end of the sheet bundle P in a transfer direction of the transfer tray 201. When the transfer tray 201 moves from the second storing unit 200 to the first storing unit 100, the sheet bundle P is moved from the second storing unit 200 to the first storing unit 100 by the transfer tray 201 with a shape thereof kept by the trailing end guide member 202.

Figure 14:
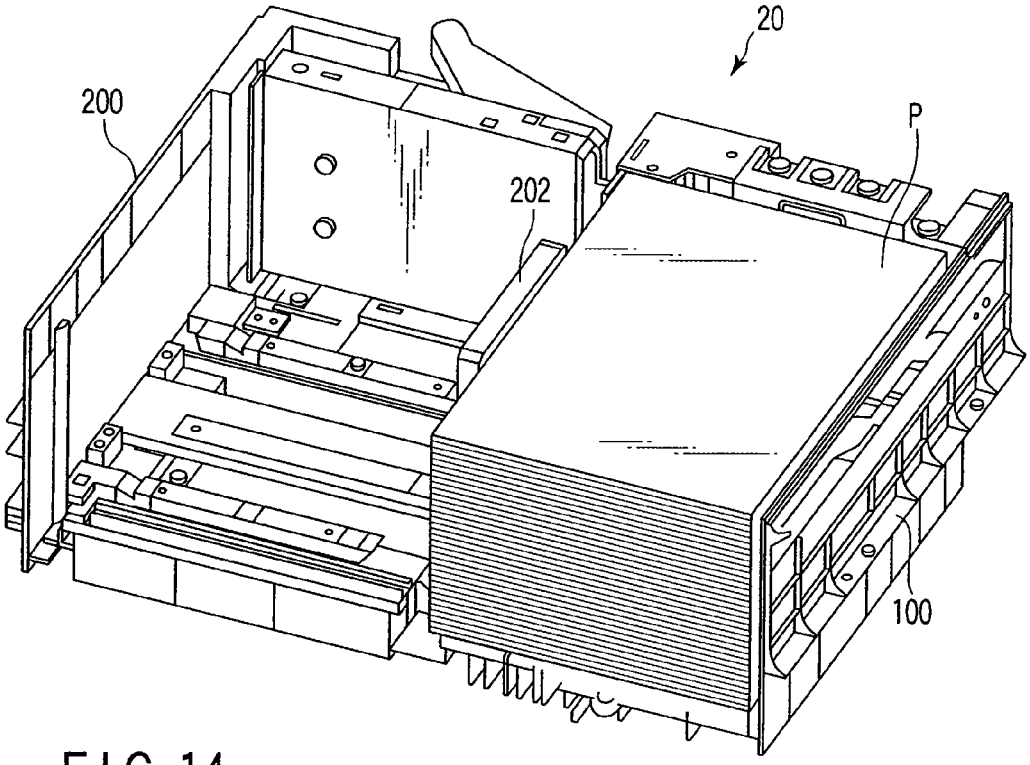
FIG. 14 is a perspective view showing the structure of the tandem LCF according to the embodiment.
Figure 15:
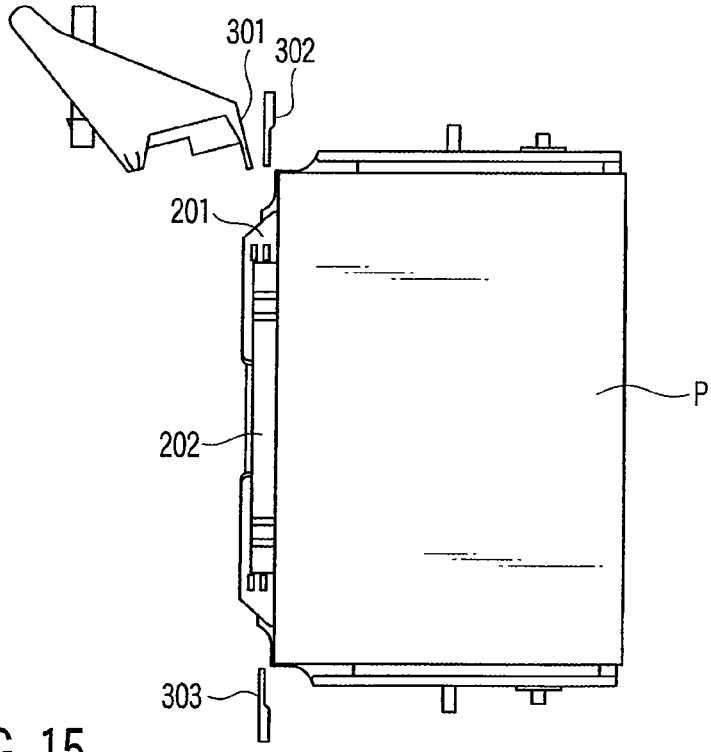
FIG. 15 is a top view showing the structure of the tandem LCF according to the embodiment.

FIG. 14 is a perspective view showing the structure of the tandem LCF 20 in a state in which the transfer tray 201 completes the transfer of the sheet bundle P to the first storing unit 100 from the state show in FIGS. 12 and 13. FIG. 15 is a top view showing the structure of the tandem LCF 20 shown in FIG. 14.

The transfer of the sheet bundle P is finished when the transfer tray 201 transfers the sheet bundle P to the predetermined position of the first storing unit 100.

Figure 16:
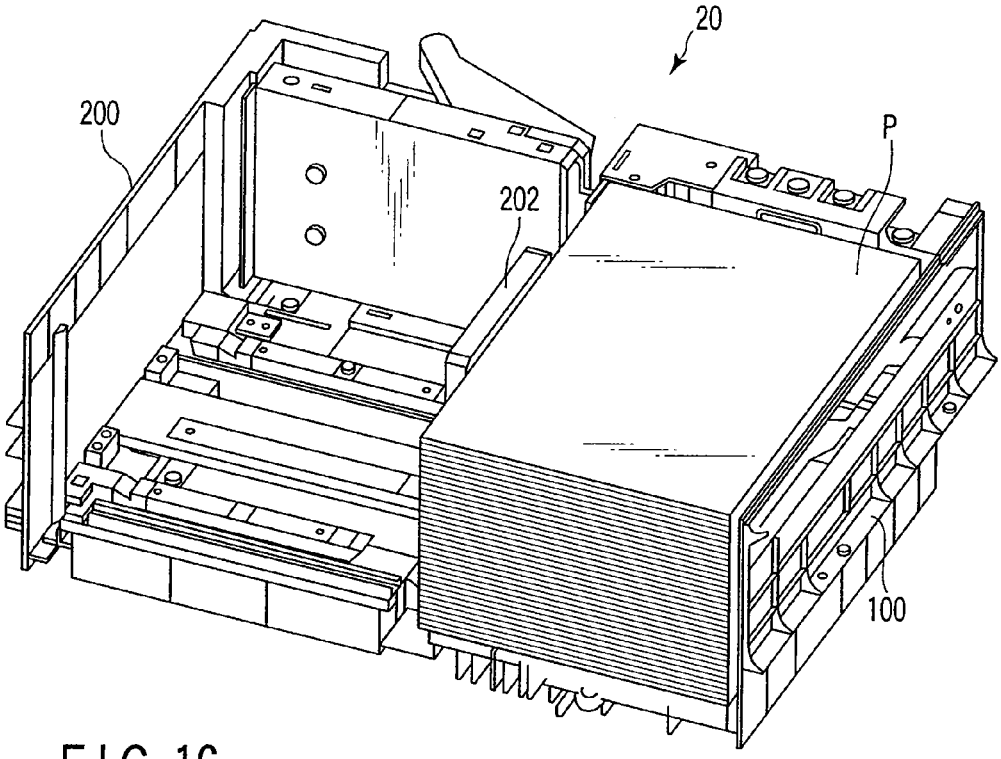
FIG. 16 is a perspective view showing the structure of the tandem LCF according to the embodiment.
Figure 17:
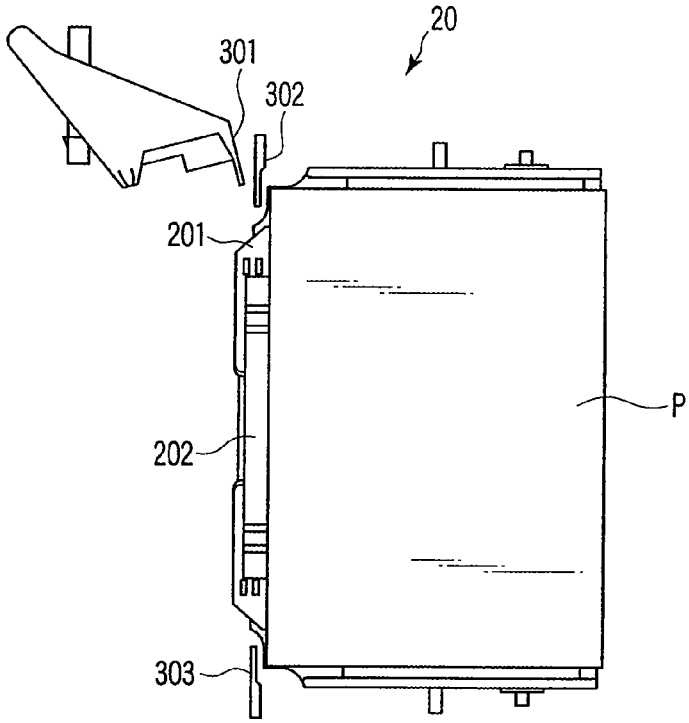
FIG. 17 is a top view showing the structure of the tandem LCF according to the embodiment.

FIG. 16 is a perspective view showing the structure of the tandem LCF 20 in a state in which the first stopper 302 and the second stopper 303 move in the state shown in FIGS. 14 and 15. FIG. 17 is a top view showing the structure of the tandem LCF 20 shown in FIG. 16.

When it is determined that the transfer tray 201 completes the transfer of the sheet bundle P to the first storing unit 100, the CPU 3 drives the stopper driving motor 307 to move the first stopper 302 and the second stopper 303 to positions where parts of the first stopper 302 and the second stopper 303 are opposed to the sheets P. The first stopper 302 and the second stopper 303 are inserted between the trailing end guide member 202 and the trailing end of the sheet bundle P.

Figure 18:
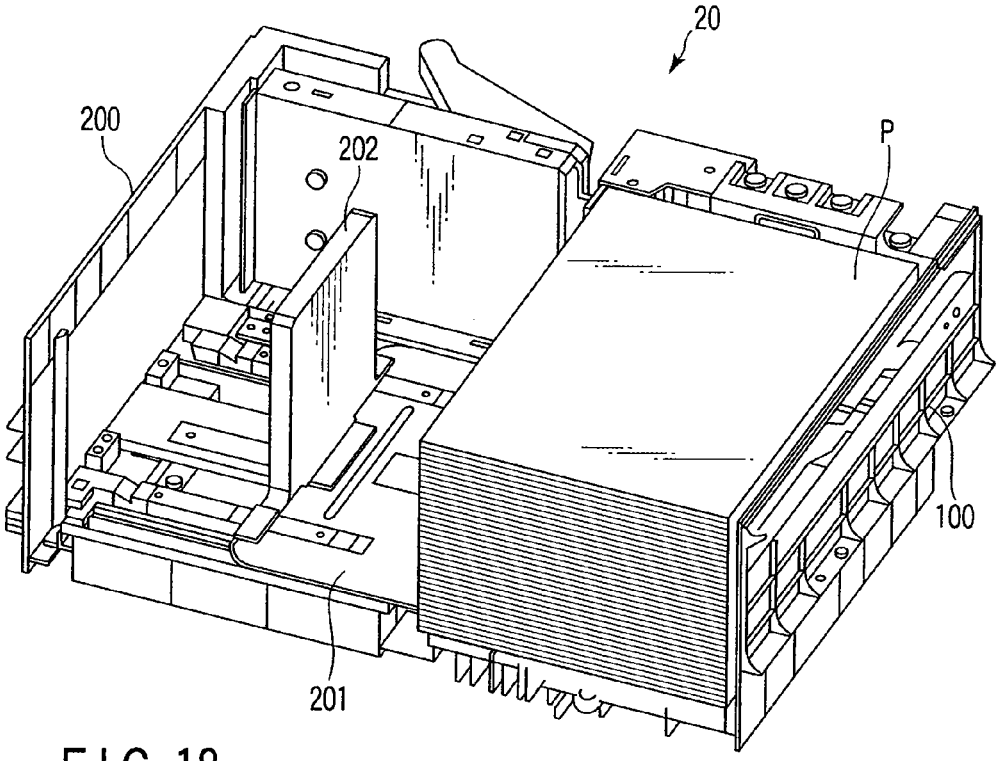
FIG. 18 is a perspective view showing the structure of the tandem LCF according to the embodiment.
Figure 19:
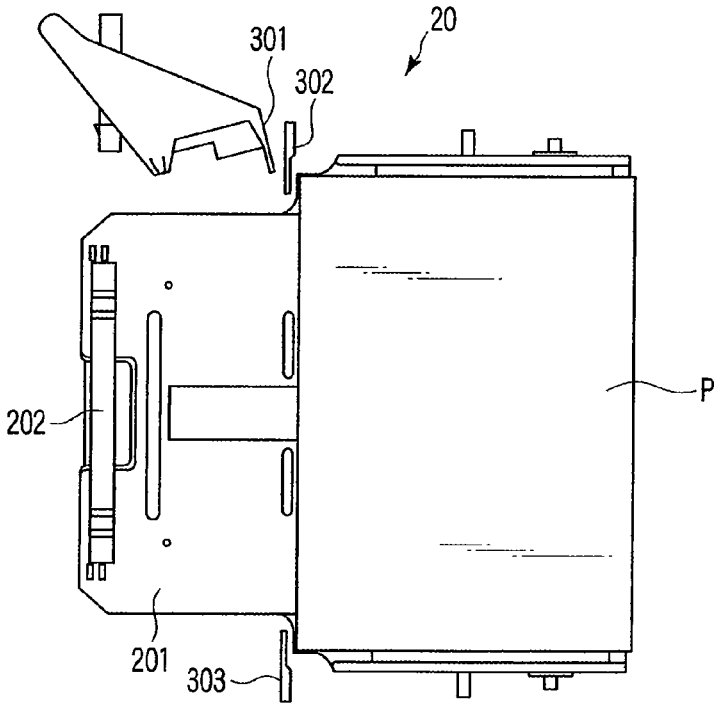
FIG. 19 is a top view showing the structure of the tandem LCF according to the embodiment.

FIG. 18 is a perspective view showing the structure of the tandem LCF 20 in a state in which the transfer tray 201 returns from the first storing unit 100 to the second storing unit 200 in the state shown in FIGS. 16 and 17. FIG. 19 is a top view showing the structure of the tandem LCF 20 shown in FIG. 18.

When it is determined that the movement of the first stopper 302 and the second stopper 303 is completed, the CPU 3 drives the transfer tray driving motor 308 to move the transfer tray 201 from the first storing unit 100 to the second storing unit 200.

Figure 20:
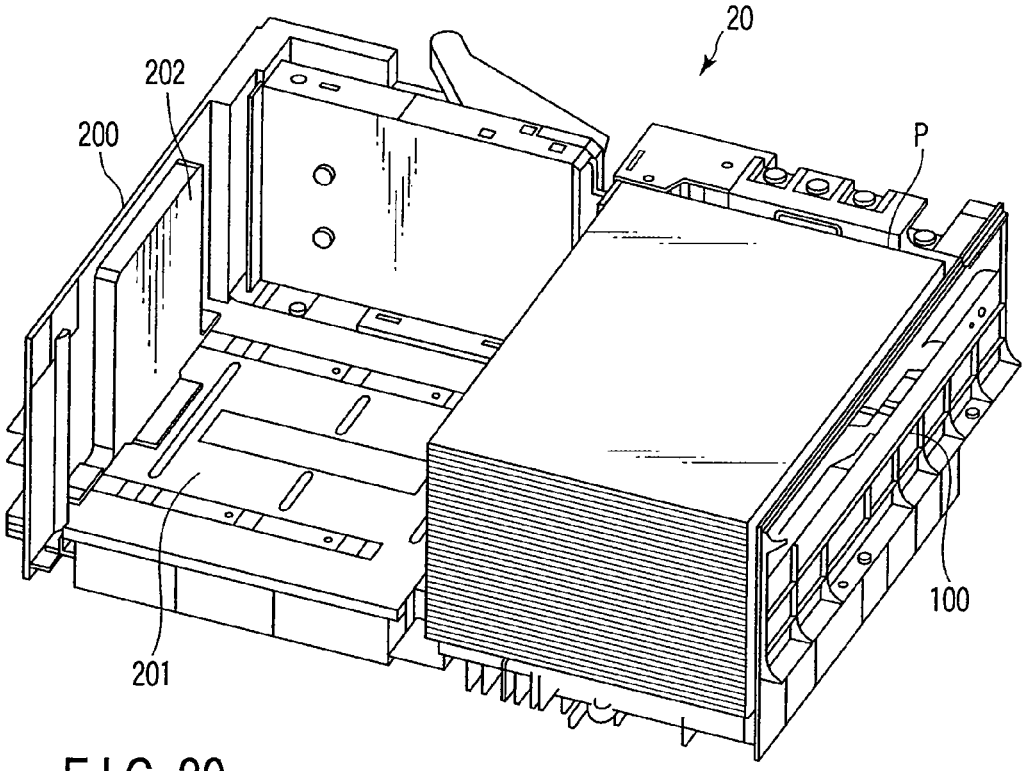
FIG. 20 is a perspective view showing the structure of the tandem LCF according to the embodiment.
Figure 21:
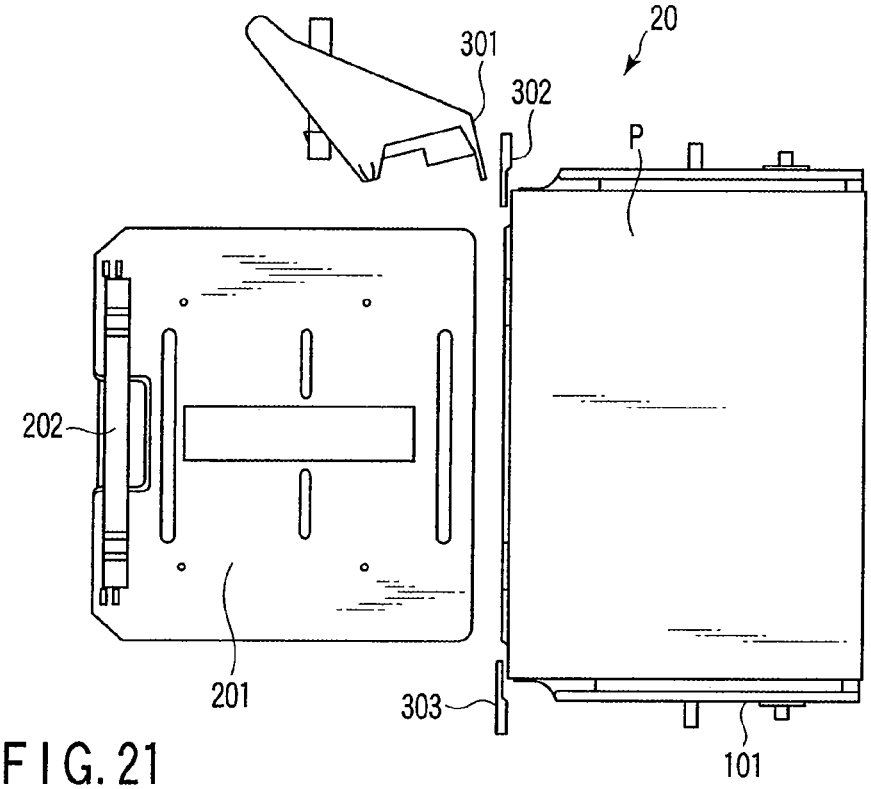
FIG. 21 is a top view showing the structure of the tandem LCF according to the embodiment.

FIG. 20 is a perspective view showing the structure of the tandem LCF 20 in a state in which the transfer tray 102 completely moves from the first storing unit 100 to the second storing unit 200 in the state shown in FIGS. 18 and 19. FIG. 21 is a top view showing the structure of the tandem LCF 20 shown in FIG. 20.

When the transfer tray 201 moves from the first storing unit 100 to the second storing unit 200, the first stopper 302 and the second stopper 303 holds the sheet bundle P from both ends thereof to prevent all the sheets of the sheet bundle P from moving following the transfer tray 201.

In other words, the first stopper 302 and the second stopper 303 set upper ends thereof at the height equal to or larger than the maximum height of the sheet bundle P that can be stacked on the transfer tray 201 and set lower ends thereof in a position just in contact with a sheet at the bottom of the sheet bundle P stacked on the transfer tray 201. Therefore, the sheet bundle P is completely prevented from moving from the first storing unit 100 to the second storing unit 200 by the first stopper 302 and the second stopper 303. The lower ends of the first stopper 302 and the second stopper 303 may be lower than the position of the bottom of the sheet bundle P.

When the transfer tray 201 moves from the first storing unit 100 to the second storing unit 200, in order to regulate the movement of the sheet bundle P, the height of the upper ends of the first stopper 302 and the second stopper 303 may be lower than the maximum height of the sheet bundle P that can be stacked. This makes use of the principle that, since the transfer tray 201 at the bottom of the sheet bundle P is drawn out, if a lower side of the sheet bundle P does not move, an upper side of the sheet bundle P does not move either.

Figure 22:
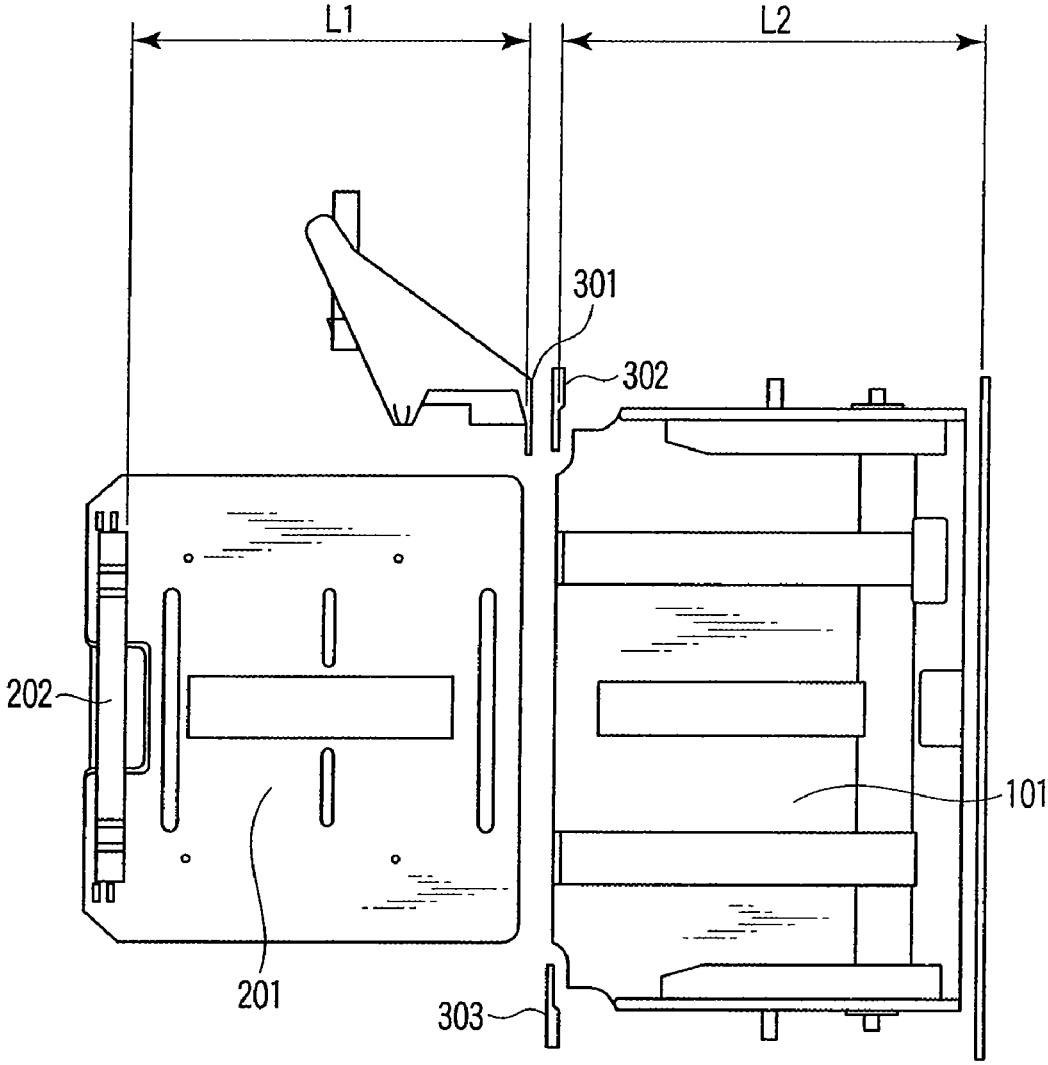
FIG. 22 is a top view showing the structure of the tandem LCF according to the embodiment.

Dimensions of the transfer tray 201 and the paper feeding side tray 101 configuring the tandem LCF 20 are explained with reference to FIG. 22. FIG. 22 is a top view showing the structure of the tandem LCF 20. The transfer tray 201 is located in the predetermined position of the second storing unit 200. A distance L1 is a distance in the transfer direction of the transfer tray 201 between the trailing end guide member 202 of the transfer tray 201 and the guide member 301 opposed to the trailing end guide member 202. A distance L2 is a distance in the transfer direction of the transfer tray 201 from the first stopper 302 and the second stopper 303 to a surface in contact with a side of the sheet bundle P in the first storing unit 100. The tandem LCF 20 is designed to satisfy a relation $L1<L2$.

Figure 23:
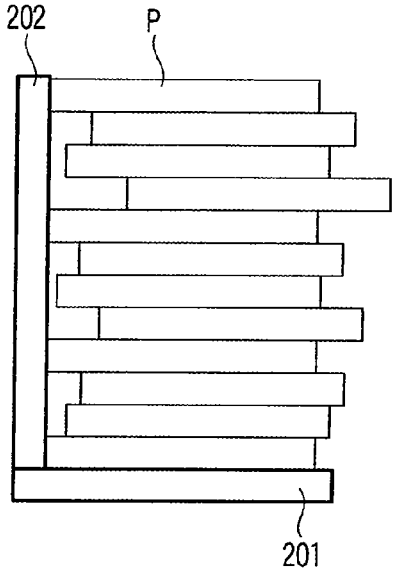
FIG. 23 is a side view showing the structure of the tandem LCF according to the embodiment.
Figure 24:
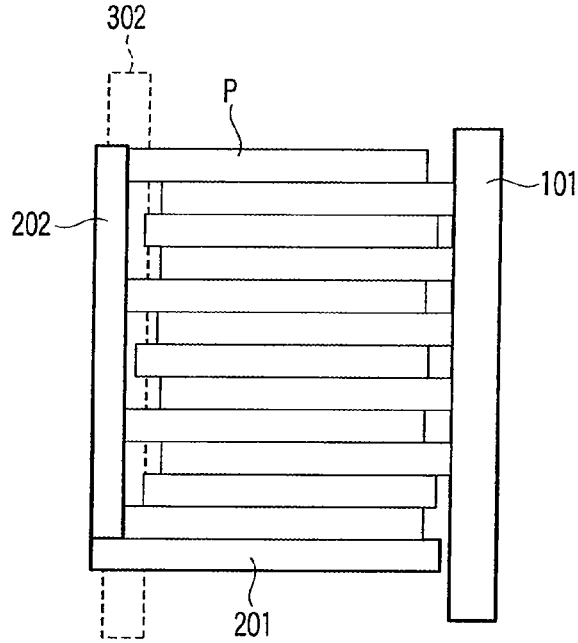
FIG. 24 is a side view showing the structure of the tandem LCF according to the embodiment.

The tandem LCF 20 not including the guide member 301 is explained. When the user stacks the sheet bundle P in the first storing unit 100 and the second storing unit 200, the user can freely stack the sheet bundle P on the transfer tray 201. When the sheets P are viewed from a side as shown in FIG. 23, the sheets P are stacked in a zigzag along the transfer direction. When the transfer tray 201 transfers the sheets P stacked in such a state, a trailing end of the sheet bundle P along the transfer direction comes into contact with an end face of the first storing unit 100. Frictional force is generated in boundaries of the sheets of the sheet bundle P. A load is imposed on the driving along the transfer direction of the transfer tray 21. Therefore, the transfer tray 201 may not be able to completely transfer the sheet bundle P to the predetermined position of the first storing unit 100.

As shown in FIGS. 16 and 17, when parts of the first stopper 302 and the second stopper 303 move to the positions opposed to the sheet bundle P, respectively, the first stopper 302 and the second stopper 303 is obstructed by the sheet bundle P and cannot move to positions opposed to the side of the sheet bundle P. Therefore, when the transfer tray 201 moves from the first storing unit 100 to the predetermined position of the second storing unit 200, the first stopper 302 and the second stopper 303 do not act on the sheet bundle P. In other words, the entire the sheet bundle P or a part of the sheet bundle P returns to the second storing unit 200 following the movement of the transfer tray 201 from the first storing unit 100 to the second storing unit 200.

In this embodiment, as shown in FIG. 22, the tandem LCF 20 is designed such that the distance L1 and the distance L2 satisfy the relation L1<L2. Therefore, when the user stacks the sheet bundle P in the second storing unit 200, an amount of fluctuation in a zigzag in the moving direction of the sheet bundle P is equal to or smaller than the distance L1. Therefore, even when the transfer tray 201 transfers the sheet bundle P to the first storing unit 100, since the distance L2 is larger than the distance L1, the transfer tray 201 can surely transfer the sheet bundle P to the predetermined position of the first storing unit 100. Therefore, the first stopper 302 and the second stopper 303 can be inserted in the positions opposed to the side of the sheet bundle P without being obstructed by the sheet bundle P. Consequently, the first stopper 302 and the second stopper 303 can hold the sheet bundle P from both the ends thereof to prevent the sheet bundle P from returning to the second storing unit 200 following the movement of the transfer tray 201.

Figure 25:
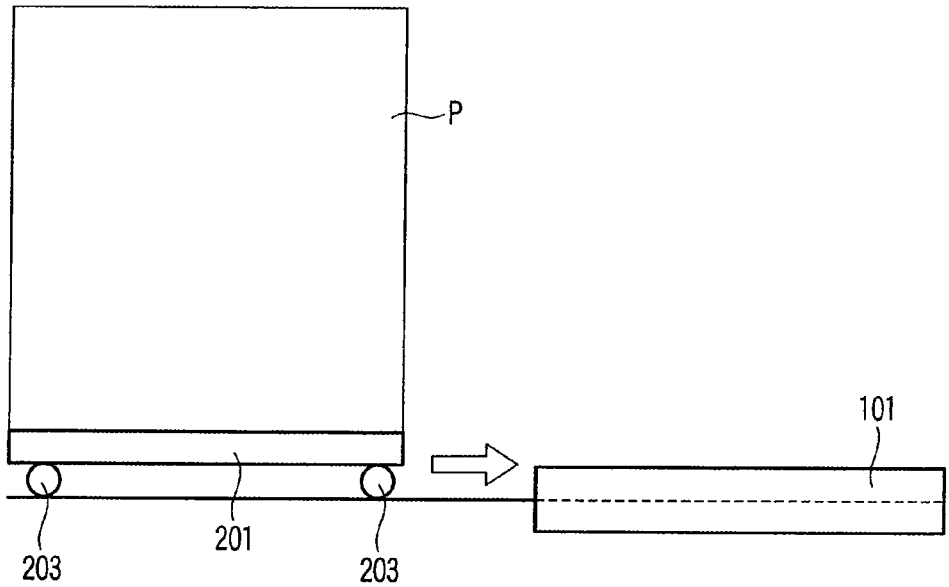
FIG. 25 is a top view showing the structure of the tandem LCF according to the embodiment.

In this embodiment, as shown in FIG. 25, rollers 203 that prevent the transfer tray 201 from hanging down are arranged below the transfer tray 201, i.e., between the transfer tray 201 and the first storing unit 100. The transfer tray 201 is guided to the first storing unit 100 by the rollers 203 on grooves provided in the first storing unit 100 and the second storing unit 200. The sheet bundle P stacked on the transfer tray 201 is surely transferred to the first storing unit 100 by the first stopper 302 and the second stopper 303. The sheet bundle P does not fall from the transfer tray 201 to the paper feeding side tray 101 at a time. Therefore, in the tandem LCF 20, it is unnecessary to provide a complicated mechanism for permitting the rollers 203 to escape from the transfer tray 201 and firmly build the transfer tray 201 and a holding section for the transfer tray 201. The tandem LCF 20 according to this embodiment is inexpensive and space-saving compared with the tandem LCF in the past and does not cause a sheet transfer failure.

What is claimed is:

1. A sheet conveying apparatus comprising:

a first storing unit in which a sheet bundle is to be stacked;

a second storing unit that is provided near the first storing unit and in which the sheet bundle is stacked;

a transfer tray that is provided in the second storing unit and transfers the sheet bundle from the second storing unit to the first storing unit;

a stopper that regulates, when the transfer tray transfers the stacked sheet bundle from the second storing unit to the first storing unit and moves from the first storing unit to the second storing unit, movement of the sheet bundle on the transfer tray;

rollers that are provided for movement with the transfer tray and guided by the first and second storing units as the transfer tray moves from the second storing unit to the first storing unit and then from the first storing unit to the second storing unit to transfer the stacked sheet bundle from the second storing unit to the first storing unit;

a guide member that moves to a position between the first storing unit and the second storing unit where the guide member does not impede the transfer of the sheet bundle in a transfer direction of the transfer tray; and a trailing end guide member that is provided in the transfer tray and comes into contact with a trailing end of the sheet bundle in the transfer direction of the transfer tray, wherein, when a distance in the transfer direction of the transfer tray between the trailing end guide member of the transfer tray and the guide member is represented as L1 and a distance in the transfer direction of the transfer tray from the stopper to a surface in contact with a side of the sheet bundle in the first storing unit is represented as L2, a relation L1<L2 is satisfied.

2. The apparatus of claim 1, wherein the stopper sets a lower end at height equal to or smaller than height of position in contact with a bottom of the sheet bundle stacked on the transfer tray.

3. The apparatus of claim 1, wherein the stopper is inserted between the trailing end guide member and the trailing end of the sheet bundle.

4. An image forming apparatus comprising:

a first storing unit in which a sheet bundle is to be stacked;

a second storing unit that is provided near the first storing unit and in which the sheet bundle is stacked;

a paper feeding member provided in the first storing unit;

a paper feeding side tray that is provided in the first storing unit to press the sheet bundle to be stacked therein against the paper feeding member;

a transfer tray that is provided in the second storing unit and transfers the sheet bundle from the second storing unit to the first storing unit;

a stopper that regulates, when the transfer tray transfers the stacked sheet bundle from the second storing unit to the first storing unit and moves from the first storing unit to the second storing unit, movement of the sheet bundle on the transfer tray; and rollers that are provided for movement with the transfer tray and guided by the first and second storing units as the transfer tray moves from the second storing unit to the first storing unit and then from the first storing unit to the second storing unit to transfer the stacked sheet bundle from the second storing unit to the first storing unit.

5. The apparatus of claim 4, further comprising a guide member that moves to a position between the first storing unit and the second storing unit where the guide member does not impede the transfer of the sheet bundle in a transfer direction of the transfer tray.

6. The apparatus of claim 5, further comprising a trailing end guide member that is provided in the transfer tray and comes into contact with a trailing end of the sheet bundle in the transfer direction of the transfer tray, wherein, when a distance in the transfer direction of the transfer tray between the trailing end guide member of the transfer tray and the guide member is represented as L1 and a distance in the transfer direction of the transfer tray from the stopper to a surface in contact with a side of the sheet bundle in the first storing unit is represented as L2, a relation L1<L2 is satisfied.

7. The apparatus of claim 4, further comprising a trailing end guide member that is provided in the transfer tray and comes into contact with a trailing end of the sheet bundle in the transfer direction of the transfer tray.

8. The apparatus of claim 7, wherein the stopper is inserted between the trailing end guide member and the trailing end of the sheet bundle.

9. The apparatus of claim 4, wherein the stopper sets a lower end at height equal to or smaller than height of position in contact with a bottom of the sheet bundle stacked on the transfer tray.

10. A sheet conveying method comprising:

providing a sheet conveying apparatus including:

a first storing unit in which a sheet bundle is to be stacked;

a second storing unit that is provided near the first storing unit and in which the sheet bundle is stacked;

a transfer tray that is provided in the second storing unit and transfers the sheet bundle from the second storing unit to the first storing unit;

a stopper that regulates, when the transfer tray transfers the stacked sheet bundle from the second storing unit to the first storing unit and moves from the first storing unit to the second storing unit, movement of the sheet bundle on the transfer tray;

rollers that are provided for movement with the transfer tray and guided by the first and second storing units as the transfer tray moves from the second storing unit to the first storing unit and then from the first storing unit to the second storing unit to transfer the stacked sheet bundle from the second storing unit to the first storing unit;

a guide member that moves to a position between the first storing unit and the second storing unit where the guide member does not impede the transfer of the sheet bundle in a transfer direction of the transfer tray; and a trailing end guide member that is provided in the transfer tray and comes into contact with a trailing end of the sheet bundle in the transfer direction of the transfer tray, wherein, when a distance in the transfer direction of the transfer tray between the trailing end guide member of the transfer tray and the guide member is represented as L1 and a distance in the transfer direction of the transfer tray from the stopper to a surface in contact with a side of the sheet bundle in the first storing unit is represented as L2, a relation L1<L2 is satisfied;

transferring the sheet bundle stacked on the transfer tray from the first storing unit to the second storing unit; and after transferring the sheet bundle to the second storing unit, regulating movement of the sheet bundle from the second storing unit to the first storing unit.

11. The method of claim 10 wherein transferring the sheet bundle further comprises pressing the trailing end of the sheet bundle and moving the sheet bundle in the transfer direction.

12. The method of claim 11, further comprising regulating the movement of the sheet bundle with a lower end set at height equal to or smaller than height of a position in contact with a bottom of the sheet bundle.

13. The method of claim 12, further comprising moving the transfer tray from the second storing unit to the first storing unit in a state in which the movement of the sheet bundle is regulated.

14. The method of claim 13, further comprising regulating the trailing end of the sheet bundle in the transfer direction of the sheet bundle.

15. The method of claim 14, further comprising, before transferring the sheet bundle, moving the guide member provided between the first storing unit and the second storing unit to a position where the guide member does not impede the transfer of the sheet bundle.

* * * * *